United States Patent [19]

Hosono et al.

[11] Patent Number: 4,785,372

[45] Date of Patent: Nov. 15, 1988

[54] METHOD AND DEVICE FOR CHARGING OR DISCHARGING MEMBER

[75] Inventors: Nagao Hosono, Hachiohji; Yukio Nagase; Tatsuo Takeuchi, both of Tokyo; Hidemi Egami, Zama; Hiroshi Satomura, Hatogava, all of Japan

[73] Assignee: Canon Kabushiki Kaisha, Tokyo, Japan

[21] Appl. No.: 907,154

[22] Filed: Sep. 15, 1986

Related U.S. Application Data

[63] Continuation of Ser. No. 618,250, Jun. 7, 1984, abandoned.

[30] Foreign Application Priority Data

Mar. 26, 1984 [JP] Japan ..... 59-57704

[51] Int. Cl.[4] ..... H05F 3/04

[52] U.S. Cl. ..... 366/225; 361/230; 361/235; 250/325

[58] Field of Search ..... 361/212–214, 361/220, 225, 229, 230, 235; 346/159; 250/324–326; 355/3 CH

[56] References Cited

U.S. PATENT DOCUMENTS 3,541,329 11/1970 Roth ..... 361/229 X
3,769,506 10/1973 Silverberg ..... 361/229 X
4,057,723 11/1977 Sarid et al. ..... 361/225 X
4,110,810 8/1978 Moore et al. ..... 361/213
4,155,093 5/1979 Fotland et al. ..... 346/159
4,333,124 6/1982 Tamura et al. ..... 361/214
4,589,053 5/1986 Hosono et al. ..... 361/213

*Primary Examiner*—L. T. Hix
*Assistant Examiner*—D. Rutledge
*Attorney, Agent, or Firm*—Fitzpatrick, Cella, Harper & Scinto

[57] ABSTRACT

A method of charging or discharging a member including the steps of, opposing to a member to be acted, a discharging member having a dielectric member, an inducing electrode and a discharging electrode sandwiching the dielectric member so that the discharging electrode faces the member to be acted, applying an alternative voltage between the inducing electrode and the discharging electrode to produce a surface discharge on a surface of the dielectric member at the discharging electrode side, moving the member to be acted relative to the discharging electrode to charge or discharge the member to be acted by the thus formed surface discharge, ceasing the production of the surface discharge by attenuating both of positive and negative, at the discharging electrode relative to the inducing electrode, components of the alternating voltage at least down to a discharge stopping voltage and then rendering the voltage zero.

12 Claims, 3 Drawing Sheets

METHOD AND DEVICE FOR CHARGING OR DISCHARGING MEMBER

This application is a continuation of application Ser. No. 618,250, filed June 7, 1984, now abandoned.

BACKGROUND OF THE INVENTION

This invention relates to a method of electrically charging or discharging a member and a discharging device using the same, which are usable with electrostatic recording, electrophotography and the like.

In the field of electrophotography and electrostatic recording, corona chargers and dischargers are known and widely used, in which a high voltage is applied to a fine wire of a diameter 0.1 mm, for example, to produce corona discharge. However, they involve a drawback that the wire is easily broken because it is thin. Also, the wire is easily stained or contaminated with dust, which results in non-uniform corona production, and therefore, non-uniform charging or discharging of a member to be charged or discharged. In addition, a conductive shield which encloses the corona wire must be remote therefrom by a certain distance, so that there is a limitation in reducing the size of the device.

Another type of discharger has been proposed, as disclosed in U.S. Pat. No. 4,155,093 corresponding to Japanese Laid-Open patent application No. 53537/1979, wherein the dielectric member is sandwiched by two electrodes. By applying alternating voltage between the electrodes, positive and negative ions are produced at the junction between the dielectric member and one of the electrodes. Of these ions, the ions of a desired porality are extracted by an external electric field. This type of discharger is advantageous in that its size can be much reduced by making the dielectric member thin (not more than 500 microns, preferably 20–200 microns), and also in that a stabilized discharge can be produced with a lower voltage (peak-to-peak, approx. 1.5–2.5 KV) than the conventional corona discharge devices.

This is because the thickness of the dielectric member is small so that the strength of the electric field can be increased between the two electrodes sandwiching the dielectric member even if the alternating voltage applied therebetween is lower. The discharging can occur, if the electric field strength is high, at an edge of one of the electrodes (discharging electrode), is large enough to produce a discharging. Then, a surface discharge takes place on the surface of the dielectric member which contacts the discharging electrode.

In this type of discharger, the discharging electrode is not so stained or dusted as in the conventional corona discharges, where the discharging wire can be easily stained or contaminated with dust in the air which attaches to the wire.

However, the inventors have found that the discharges of the above described type can also be stained or contaminated with dust during use. This adversely affects the surface discharge so that the extension of the surface discharge in the direction of the width becomes not uniform along the length of the discharger, or that the degree of the extention is different from the initial or intended one. So, it has been difficult to provide a stable and uniform discharging at all times.

SUMMARY OF THE INVENTION

It is a principal object of the present invention to provide a method by which the stain or dusting of the discharging electrode can be minimized.

It is another object of the present invention to provide a method by which uniform and stabilized discharging can be provided at all times.

It is further object of the present invention to provide a method by which the discharging electrode does not attract dust in the air when it is not operated.

These and other objects, features and advantages of the present invention will become more apparent upon a consideration of the following description of the preferred embodiments of the present invention taken in conjunction with the accompanying drawings.

According to an embodiment of the present invention, the discharge operation ceases without retaining the surface discharge on the surface of the dielectric member, so that the dust or other foreign matter is not attracted thereto when the device is not being operated.

DESCRIPTION OF THE PREFERRED EMBODIMENT

Figure 1:
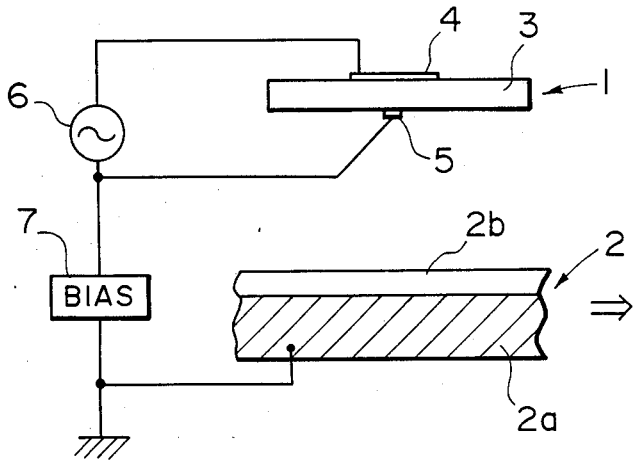
FIG. 1 shows a discharging device according to an embodiment of the present invention.
Figure 2:
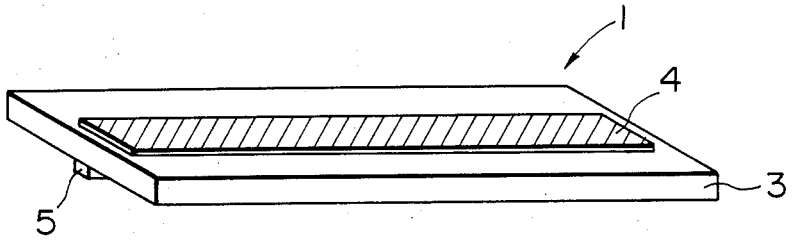
FIG. 2 is a perspective view of a discharging member used with the discharging device shown in FIG. 1.

Referring to FIG. 1, there is shown a discharging device according to the present invention, which includes a discharging member 1 opposed to a member 2 to be charged or discharged (hereinafter simply called a member to be charged). The discharging member 1 comprises a dielectric member 3, an inducing electrode 4 and a discharging electrode 5. FIG. 2 is a perspective view of the discharging member 1. The discharging electrode 5 is a single linear elongate member disposed so as to extend along the center of the inducing electrode 4.

Between the inducing electrode 4 and the discharging electrode 5, an alternating voltage is applied by alternating voltage applying means 6. On the other hand, the member 2 to be charged which is moved in the direction of arrow A relative to the discharging device 1, comprises a conductive base member **2*a* and an insulating or photoconductive member 2*b*. Between the conductive layer 2*a* and the discharging electrode 5, a bias voltage is applied by bias voltage applying means 7**.

In operation, when the alternating voltage is applied between the inducing electrode 4 and the discharging electrode 5, an electric discharging occurs adjacent to the discharging electrode 5 to produce sufficient positive and negative ions. Because of the bias voltage applied between the discharging electrode 5 and the conductive base 2*a* of the member 2 the positive or negative ions are selectively extracted and directed to the insulating or photoconductive layer 2*b* surface of the member 2 so as to charge it to a desired level in the selected polarity.

As for the material of the dielectric member, a relatively high hardness material, such as ceramics, mica, glass or the like, or a flexible organic high polymer, such as polyimide regin, ethylene tetrafluoride, polyester, acrylic material vinyl chloride polyethylene or the like, may be used.

Figure 3A:
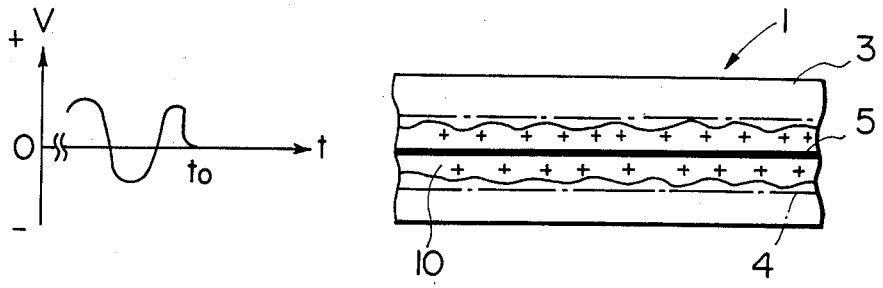
FIGS. 3A and 3B show the voltage wave form when the voltage supply is cut without using the present invention, and show the state of the charge adjacent the discharging electrode.
Figure 3B:
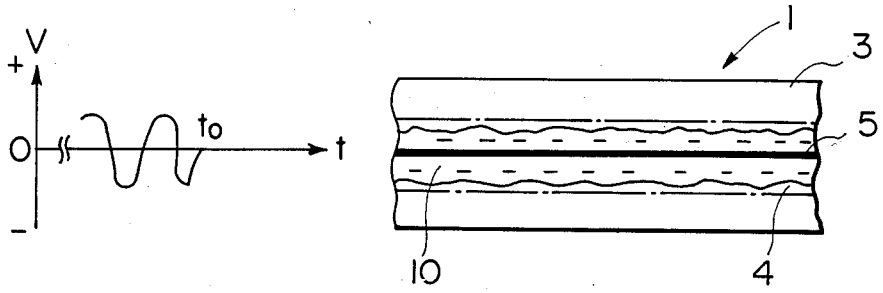
Figure 3C:
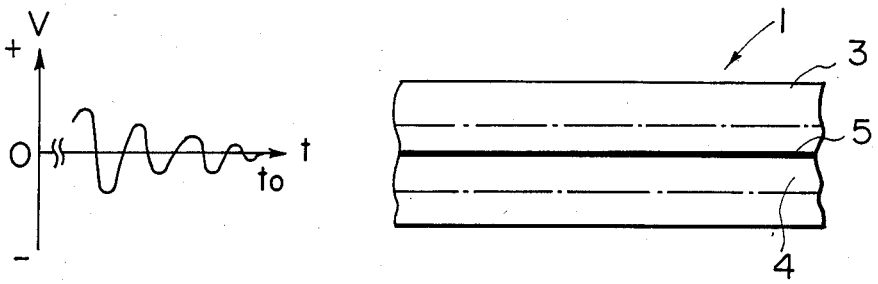
FIGS. 3C show the voltage wave form when the voltage supply is cut, using the present invention, and show the state of the charge adjacent to the discharging electrode.

FIGS. 3A, 3B and 3C show the states of surface charge remaining on the surface of the dielectric member 3 when the alternating voltage supply is stopped to render the discharging device inoperative, after the member 2 is charged. The righthand portions of these Figures illustrate the discharging member 1 seen from the discharging electrode 5 side. The inducing electrode 4 is shown by chain lines. The lefthand portions of these Figures show the waveform of the voltage existing between the inducing electrode 4 and the discharging electrode 5 when the discharging operation is going to stop. The voltage is shown as being stopped at a peak and then becoming 0 at the time $t=t_0$.

FIG. 3A is directed to the case where a positive voltage (+1.5 KV) is applied to the discharging electrode 5 relative to the inducing electrode 4, when the voltage supply is going to stop, and it becomes 0. Before the voltage reaches 0 volt, there are positive ions adjacent to the discharging electrode 5. After a zero voltage level has been reached, the positive charge remains in the surface discharge area extending from the discharging electrode at the both sides thereof. The surface potential of the dielectric member 3 by the remaining charge was max. 200 volt relative to the inducing electrode 4.

FIG. 3B is directed to the case where a negative voltage (−1.5 KV) is applied to the discharging electrode 5 relative to the inducing electrode 4, when the voltage supply is going to stop and it becomes 0. Before the voltage reaches a zero voltage level, there are negative ions adjacent to the discharging electrode 5. After a zero voltage level has been reached, the negative charge remains in the surface discharge area extending from the discharging electrode at the both sides thereof. The surface potential of the dielectric member 3 by the remaining charge was max. −200 volt relative to the inducing electrode 4.

Generally speaking, upon the discharging operation of the discharging member 1, a very strong electric field is applied across the dielectric member 3. Therefore, the material of the dielectric member 3 must be highly insulative and must be highly durable. Therefore, the resistivity of the dielectric member 3 is necessarily high.

For this reason, the dielectric member 3 remains charged at the termination of the discharging operation. Since the charged state is kept, the dielectric member 3 surface electrostatically attracts thereto charged particles in the air, such as cigarette smoke, toner particles or the like. This is the cause of stain of the discharging member 1.

Figure 4:
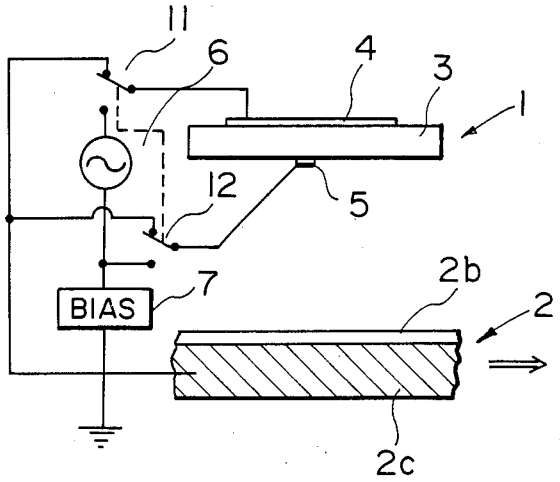
FIG. 4 shows an electric circuit when the present invention is not used.

FIG. 4 shows a voltage supply circuit for FIGS. 3A and 3B cases. The AC source 6 as the alternating voltage applying means and the bias source 7 are controlled by the switches 11 and 12 which are interrelated for simultaneous operation.

FIG. 3C is concerned with the present invention wherein the alternating voltage (for example, 3 KV of peak-to-peak) applied between the inducing electrode 4 and the discharging electrode 5 is first gradually attenuated to below the discharge stopping level of the voltage and then cut. It has been confirmed, by this method, that no charge remains on the dielectric member 3 surface at both sides of the discharging electrode 5, that is, it is substantially free from electric charge.

The reason for this is as follows: Both of the positive and negative components (positive polarity and negative polarity) of the alternating voltage, at the side of the discharging electrode 5 relative to the side of the inducing electrode 4, are gradually attenuated. Therefore, the amount of charge deposited on the surface of the dielectric member 3 at both sides of the discharging electrode 5, which surface is contacted by the discharging electrode, or the amount of ions produced at both sides of the discharging electrode 5, gradually decreases. Then, the strength at both sides of the discharging electrode 5 becomes not more than the strength which is required for the occurrence of discharge (the discharge stopping voltage). The discharging stops prior to the stop of the alternating voltage supply. After this, the alternating voltage may be made zero immediately or may be further attenuated and then made zero. In either of these cases, hardly any charge remains on the surface of the dielectric member 3 at both sides of the discharging electrode 5. More particularly, the surface potential of the dielectric member 3 was not more than several volts relative to the inducing electrode.

Discharging members which had been stopped in the manner shown in FIGS. 3A, 3B and 3C were kept for 6 hours in a casing in the presence of abundant cigarette smoke, toner particles cotton waste and other dust. It has been confirmed that the discharging member 1 stopped in accordance with FIG. 3C attracts remarkably less contaminants relative to those discharging members stopped in accordance with FIGS. 3A and 3B, at the surface of the dielectric member 3.

Then charging operations were carried out with those discharging members as taken out of the casing in the manner shown in FIG. 1. Much more uniform charging, (which was as uniform as before the stopping), was obtained with the discharging member stopped in the manner of FIG. 3C than with those stopped in the manner of FIGS. 3A and 3B. More particularly, the discharging member having been provided with plus and minus 6% non-uniformness of the charging and having been stopped in the manner of FIGS. 3A and 3B was kept in the above-described casing was operated again. Then the resultant non-uniformness was increased to plus and minus 10%. In the case of FIG. 3C, the resultant non-uniformness was plus and minus 6%, the same as before the stop.

In the above experiments, polyimide film of 75 mictons thickness was used as the dielectric member 3. Both surfaces thereof were laminated by copper foils of 75 microns and was etched to provide the inducing electrode 4 and the discharging electrode 5. Thus, the discharging member 1 was formed. Between the inducing electrode 4 and the discharging electrode 5, an alternating voltage of peak-to-peak value, 3 KV and frequency, 10 KHz was applied by the alternating voltage applying means. The member 2 charged was of a polyester large of 25 microns thickness. As for the bias voltage, 2 KV DC current was applied by the bias voltage applying means 7.

As for the waveform of the AC voltage applied between the inducing electrode 4 and the discharging electrode 5, a sine wave and a pulse wave were used, and they showed the same results.

When the present invention is used with electrophotography, there is an additional advantage. Generally speaking, it is desirable in the electrophotography that there is no electric field formed across a photosensitive member when in inoperative state because then the cigarette smoke or dust will not be deposited thereon. According to the present invention, there is no charge at the surface of the discharging member 1 opposed to the photosensitive member, so that there is no undesirable electric field.

Figure 5:
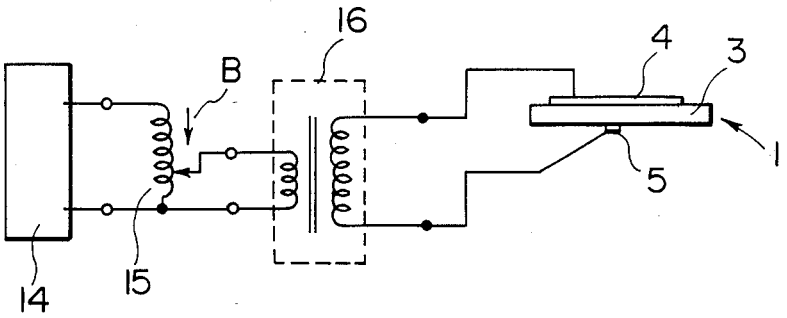
FIG. 5 shows a device embodying the method of the present invention.

FIG. 5 shows a device for embodying the method of the present invention, wherein the high frequency oscillator 14 is connected to a step-up transformer 16 through a voltage slider 15 to apply an alternating voltage to the discharging member 1. When the stopping signal is produced, the contact of the voltage slider moves in the direction of arrow B to attenuate the positive and negative, at the discharging electrode relative to the inducing electrode, components to below the discharge stopping voltage, and then the voltage is made to be zero. This may be effected by use of other than the voltage slider, for example, by electric circuits or another electric connection.

The foregoing explanation has been made with respect to the charging or a member. Where the discharging device is placed closer to the member, the member can be discharged, that is, an electric charge can be removed from the member. In this case, the voltage source 7 is not necessary. The present invention described is usable, and the advantages thereof can be provided, also in this case.

The voltage source 7, when used, may supply a DC voltage or pulsating voltage if the ions generated near the discharging electrode 5 can be directed to the member to be charged or discharged. The voltage of the voltage source 7 has been described as applying the voltage between the discharging electrode 5 and the member 2 to be charged or discharged, but it may be applied between the inducing electrode 4 and the member to be charged or discharged. While the embodiment of the present invention has been described with respect to the exemplary discharging member having a single discharging electrode, the present invention is applicable to the case where the discharging electrode includes plural rows of discharging electrode members.

As described above, according to the present invention, the occurrence of the remaining charge on the dielectric member surface at both sides of the discharging electrode can be prevented, so that foreign matter is prevented from attaching to the surface discharge area of the dielectric member surface, when the device is inoperative. Therefore, even if it is kept in a contaminated atmosphere for a long time, the operation thereof can be started immediately. Also, when the present invention is used with electrophotography, there is no possibility that an electric field across a photosensitive member continues to exist.

While the invention has been described with reference to the structures disclosed herein, it is not confined to the details set forth and this application is intended to cover such modifications or changes as may come within the purposes of the improvements or the scope of the following claims.

What is claimed is:

1. A method of charging or discharging a member comprising the steps of:

providing a discharging member which includes a solid dielectric member having first and second surfaces extending in one direction, an inducing electrode extending in the one direction along and in contact with the first surface of the solid dielectric member and having a width smaller than that of the first surface of the solid dielectric member and a discharging electrode extending in the one direction along and in contact with a second surface of the solid dielectric member, said inducing electrode and said discharging electrodes sandwiching the solid dielectric member therebetween, wherein the discharging electrode has an exposed side and has a width, measured in a direction perpendicular to the one direction, which is smaller than that of the inducing electrode;

positioning a member to be charged or discharged adjacent the exposed side of the discharging electrode;

applying an alternating voltage between the inducing electrode and the discharging electrode to produce a surface discharge on the second surface of the solid dielectric member which is adjacent the discharging electrode;

moving the member to be charged or discharged relative to the discharging electrode to charge or discharge the member to be charged or discharged by the thus formed surface discharge; and attenuating the alternating voltage at least down to a voltage at which said surface discharge is not produced, when the application of the alternating voltage to the discharging member is to be stopped, and subsequently reducing said alternating voltage to zero, thereby to minimize electric charge retained on the second surface of the solid dielectric member where the surface discharge occurs.

2. A method according to claim 1, wherein the alternating voltage is in a sine wave form.

3. A method according to claim 1, wherein the alternating voltage is in a rectangular wave form.

4. A method according to claim 1, wherein the discharging electrode includes plural rows of discharging electrode members.

5. A method according to claim 1, further comprising the step of forming a bias electric field between the discharging electrode and the member to be charged or discharged to move ions produced by the surface discharge and having a predetermined polarity relative to the member to be charged or discharged.

6. A method according to claim 1, wherein said discharging electrode has a width smaller than that of a second surface of said solid dielectric member.

7. A device for charging or discharging a member, comprising:

a discharging member which includes a solid dielectric member having first and second surfaces extending in a direction, an inducing electrode extending in said direction along and in contact with said first surface of said solid dielectric member and having a width smaller than that of the first surface of the solid dielectric member, and a discharging electrode extending in said direction along and in contact with said second surface of said solid dielectric member, said inducing electrode and said discharging electrode sandwiching said solid dielectric member therebetween, wherein said discharging electrode has an exposed side and has a width, measured in a direction perpendicular to said direction, which is smaller than that of the inducing electrode, and wherein said exposed side of said discharging electrode is adapted to be opposed to a member to be charged or discharged;

a power source of applying an alternating voltage between said inducing electrode and said discharging electrode to produce a surface discharge on said second surface of said solid dielectric member adjacent said discharging electrode; and means for attenuating the alternating voltage at least down to a voltage at which said surface discharge is not produced, where the application of the alternating voltage to said discharging member is to be stopped, and for subsequently reducing said alternating voltage to zero, thereby to minimize electric charge retained on the second surface of the solid dielectric member when the surface discharge occurs.

8. A device according to claim 7, further comprising means for applying a bias electric field between said discharging electrode and the member to be charged or discharged to move ions produced by the surface discharge and having a predetermined polarity relative to the member to be charged or discharged.

9. A device according to claim 7, wherein said discharging electrode has a width smaller than that of a second surface of said solid dielectric member.

10. A device according to claim 7, wherein the alternating voltage is in a sine wave form.

11. A device according to claim 7, wherein the alternating voltage is a rectangular wave form.

12. A device according to claim 7, wherein the discharging electrode includes a plurality of discharging electrode members.

* * * * *

UNITED STATES PATENT AND TRADEMARK OFFICE

CERTIFICATE OF CORRECTION

PATENT NO. : 4,785,372

DATED : November 15, 1988

INVENTOR(S) : Hosono, et al.

It is certified that error appears in the above-identified patent and that said Letters Patent is hereby corrected as shown below:

COLUMN 1

Line 34, "poral-" should read --polar---.
Line 56, "discharges," should read --dischargers,--.
Line 60, "charges" should read --chargers--.

COLUMN 2

Line 32, "FIGS.3C show" should read --FIG.3C shows--.
Line 34, "show" should read --shows--.

COLUMN 4

Line 33, "particles" should read --particles,--.
Line 36, "less" should read --fewer--.
Line 49, "was" should read --and--.
Line 55, "tons" should read --rons--.
Line 64, delete "large".

UNITED STATES PATENT AND TRADEMARK OFFICE

CERTIFICATE OF CORRECTION

PATENT NO. : 4,785,372

DATED : November 15, 1988

INVENTOR(S) : Hosono, et al

It is certified that error appears in the above-identified patent and that said Letters Patent is hereby corrected as shown below:

COLUMN 5

Line 27, "or" should read --of--.

Signed and Sealed this

Twenty-sixth Day of September, 1989

*Attest:*

DONALD J. QUIGG

*Attesting Officer*

*Commissioner of Patents and Trademarks*